United States Patent [19]

Klaila

[11] Patent Number: 5,055,180

[45] Date of Patent: Oct. 8, 1991

[54] METHOD AND APPARATUS FOR RECOVERING FRACTIONS FROM HYDROCARBON MATERIALS, FACILITATING THE REMOVAL AND CLEANSING OF HYDROCARBON FLUIDS, INSULATING STORAGE VESSELS, AND CLEANSING STORAGE VESSELS AND PIPELINES

[75] Inventor: William J. Klaila, Tulsa, Okla.

[73] Assignee: Electromagnetic Energy Corporation, Middleboro, Mass.

[21] Appl. No.: 637,975

[22] Filed: Jan. 9, 1991

Related U.S. Application Data

[63] Continuation of Ser. No. 511,860, Apr. 12, 1990, abandoned, which is a continuation of Ser. No. 320,887, Mar. 9, 1989, abandoned, which is a continuation of Ser. No. 602,399, Apr. 20, 1984, abandoned.

[51] Int. Cl.[5] ..... C10G 1/00

[52] U.S. Cl. ..... 208/402; 166/248; 175/66; 208/401

[58] Field of Search ..... 175/66; 166/268, 248; 208/401, 402

[56] References Cited

U.S. PATENT DOCUMENTS

| | | | |
|---|---|---|---|
| Re. 31,241 | 5/1983 | Klalia | 431/11 |
| 2,685,930 | 8/1954 | Albaugh | 166/39 |
| 2,753,928 | 7/1958 | Vanderlip | 158/36.3 |
| 2,757,738 | 8/1956 | Ritchey | 166/39 |
| 3,092,514 | 6/1964 | Tomberlin | 134/1 |
| 3,104,711 | 9/1963 | Haagensen | 166/60 |
| 3,133,592 | 5/1964 | Tomberlin | 166/60 |
| 3,170,519 | 2/1965 | Haagensen | 166/60 |
| 3,208,674 | 9/1965 | Bailey | 241/1 |
| 3,428,125 | 2/1965 | Parker | 166/248 |
| 3,462,575 | 8/1969 | Holaday | 219/10.55 |
| 3,535,482 | 10/1970 | Kluck | 219/10.55 |
| 3,718,186 | 2/1973 | Brandon | 166/248 |
| 3,778,578 | 12/1973 | Long et al. | 219/10.55 |
| 3,812,315 | 5/1974 | Martin | 219/10.55 |
| 3,891,817 | 6/1975 | Brown | 219/10.55 R |
| 3,920,945 | 11/1975 | Smith et al. | 219/10.55 R |
| 3,948,319 | 4/1976 | Pritchett | 166/248 |
| 3,989,107 | 11/1976 | Fisher et al. | 166/248 |
| 4,008,761 | 2/1977 | Fisher et al. | 166/248 |
| 4,008,762 | 2/1977 | Fisher et al. | 166/248 |
| 4,135,579 | 1/1979 | Rowland et al. | 166/248 |
| 4,140,179 | 2/1979 | Kasench et al. | 166/248 |
| 4,140,179 | 2/1979 | Kasevich et al. | 166/248 |
| 4,140,180 | 2/1979 | Bridges et al. | 166/248 |
| 4,376,034 | 3/1983 | Wall | 166/120 |
| 4,417,311 | 11/1983 | Ryan | 208/DIG. 1 |
| 4,419,214 | 12/1983 | Balint et al. | 208/8 R |

FOREIGN PATENT DOCUMENTS

| | | | |
|---|---|---|---|
| 547388 | 10/1957 | Canada . | |
| 1108081 | 2/1977 | Canada | 166/248 |
| 2427031 | 12/1975 | Fed. Rep. of Germany | 166/248 |
| 578448 | 10/1977 | U.S.S.R. | 166/248 |

OTHER PUBLICATIONS

Microwave Heating in Freeze-Drying, Electronic Ovens, and Other Applications, David A. Copson, Ph.D 1962-p. 372.

Electronic Progress, vol. IX, No. 4, 1965.

Chemistry and Industry, Methods, Apparatus; New Product Research, Process Development and Design-Y. C. Fu—Jul. 31, 1971.

Extract from Oil and Tar Sands—Richard Lyttle—1982, p. 28.

Journal of Microwave Power, vol. 18, p. 1, Electromagnetic Techniques in the In-Situ Recovery of Heavy Oils—F. E. Vermeulen and F. S. Chute, —1983.

Chemical Week—Technology—Getting Sulfur out of Petroleum Coke—Apr. 4, 1984.

*Primary Examiner*—Asok Pal

*Attorney, Agent, or Firm*—Herbert L. Bello

[57] ABSTRACT

The method and associated apparatus for recovering fractions from hydrocarbon material, comprising the steps of generating electromagnetic energy generally in the frequency range of from about 300 megahertz to about 300 gigahertz, in accordance with the lossiness of the material, transmitting the generated electromagnetic energy to the hydrocarbon material, sensing the temperature of the hydrocarbon material, varying the electromagnetic energy in accordance with the sensed temperature, exposing the hydrocarbon material to the electromagnetic energy for a sufficient period of time to sequentially separate the hydrocarbon material into fractions, and removing the resulting fractions.

22 Claims, 7 Drawing Sheets

18
95E
94
70
95D
95C
95A
95B 18
70
91
93

21
86
18
90
88
70

18
82
250
94

18
64
70

164
162
166
172
170
150
176
168
160
180
178
174
184
182
158
191
192
200
212
208
210
206
186
190
152
154
196
196
199
198
204
194
194
187
202
188

METHOD AND APPARATUS FOR RECOVERING FRACTIONS FROM HYDROCARBON MATERIALS, FACILITATING THE REMOVAL AND CLEANSING OF HYDROCARBON FLUIDS, INSULATING STORAGE VESSELS, AND CLEANSING STORAGE VESSELS AND PIPELINES

This is a continuation of co-pending application Ser. No. 07/511,860, filed Apr. 12, 1990, which is a continuation of Ser. No. 07/320,887, filed Mar. 9, 1989, which is a continuation of Ser. No. 06/602,399, filed Apr. 20, 1984, all now abandoned.

BACKGROUND OF THE INVENTION

The present invention relates to the treatment of hydrocarbon material with electromagnetic energy, and more particularly to a method and apparatus for recovering fractions from hydrocarbon material, facilitating the removal and cleansing of hydrocarbon fluids, insulating storage vessels, and cleaning storage vessels and pipelines.

The existing techniques of heating hydrocarbon material such as coal, lignite, peat, and kerogen or hydrocarbon fluids, i.e., those having a kinematic viscosity in the range of about 20 seconds Saybolt Universal to about 500,000 seconds Saybolt Universal at 100° F., with conventional thermal conduction methods using steam, hot water, electric coils, plates, piping or tracers has only met with limited success due to the poor thermal conductivity of the hydrocarbon fluid. Further, even with extremely high temperature gradients and therefore energy expenditure these techniques still fail to achieve penetration into the fluid to any great distance when it is immobile. Hydrocarbon materials such as coal, oil shale and tar sands remain locked in geological formations for somewhat similar reasons, although some modest degree of success has been achieved in in situ removal by using fire floods, solvents, polymers, bacteria, water floods and steam floods, so-called "Huff and Puff."

The physical characteristics of oil sands oil, bitumen, oil shale, peat, and lignite, are quite different from those of conventional crude oil. The oil sands bitumen, oil shale, peat and lignite is much heavier and much more viscious than conventional crude oil, so that under reservoir conditions it is essentially immobile. In fact, the oil sands bitumen, oil shale, peat and lignite has essentially the consistency of tar and can be induced to flow only if the reservoir conditions are suitably altered, for instance by raising its temperature. Particularly in the last two decades, a variety of in situ recovery techniques have been studied, including such methods as the underground injection of steam, hot water and hot gas, ignition of the oil within the formation, and underground atomic explosions. A common goal of these techniques is to transfer heat to the oil formation to raise the temperature of the very viscious oil sufficiently above the in situ temperature of 10° C. to 15° C. so that the oil can flow and be swept from the host formation by a suitable pressurized gas or other pressurized fluid driving agent. Since the formation is quite impermeable and has very low thermal conductivity, heat transfer by conduction and convection, as in the foregoing methods, is a very slow process. Moreover, control of the movement of the injected heating fluid within the formation is difficult so that a major unsolved problem of in situ technology is that of directing the fluid to the region which is to be heated, this region being generally the volume of the formation between a system of injection and production wells.

U.S. Pat. Re. No. 31,241, reissued on May 17, 1983, discloses a method and apparatus for controlling the fluency of hydrocarbon fluids by using electromagnetic energy. In accordance with the method, hydrocarbon fluid present in a geological substrate or container is heated by electromagnetic energy in the frequency range of from about 300 megahertz to about 300 gigahertz to release the hydrocarbon fluid by increasing its fluency. The released hydrocarbon fluid is then removed. A heating system for an oil burner and an apparatus for increasing the fluency by heating a contained hydrocarbon fluid is also disclosed.

Heating with RF waves is generally an absorptive heating process which results from subjecting polar molecules to a high frequency electromagnetic field. As the polar molecules seek to align themselves with the alternating polarity of the electromagnetic field, work is done and heat is generated and absorbed. When RF energy is applied to hydrocarbons which are trapped in a geological formation, the polar molecules, i.e., the hydrocarbons and connate water, are heated selectively, while the non-polar molecules of the formation are virtually transparent to the RF energy and absorb very little of the energy supplied.

Unlike steam flooding, which depends on pressure to maintain temperature, RF waves can produce very high temperatures within hydrocarbon materials, such as kerogen in shale formations, without requiring pressure. So called "thief zones" which channel off steam from the desired payzone or seam with conventional techniques are of minor consequence in the case of RF waves since most of the energy will be absorbed in the payzone or seam to which it is directed.

There are numerous storage stock tanks, ship bunkers, pipelines, tankers and vessels which contain varying amounts of high viscosity oil which it is economically impractical to salvage. The high viscosity oil and sludge found at the bottom of oil tankers is presently removed by bulldozers which gain access to the hold of the tanker through an opening created in the hull. After removal of the sludge, the hull is resealed. This process is time consuming, expensive and wasteful.

The present invention represents an improvement over the method and apparatus disclosed in the aforementioned reissue patent for facilitating the removal of hydrocarbon fluids as well as providing a novel method and apparatus for recovering fractions from hydrocarbon materials, facilitating the removal and cleansing of hydrocarbon fluids, insulating storage vessels, and cleaning storage vessels and pipelines.

SUMMARY OF THE INVENTION

It is an object of the present invention to provide an improved method and apparatus for heating hydrocarbon material with electromagnetic energy.

It is a further object of the present invention to provide a method and apparatus for separating hydrocarbon material into fractions.

It is a still further object of the present invention to provide a method and apparatus for removing high viscosity hydrocarbon fluids and sludge from oil tankers.

It is a still further object of the present invention to provide a method and apparatus for producing clean oil from the contaminated oil obtained from a wellbore.

It is a still further object of the present invention to provide an improved method and apparatus for removing paraffin from the surfaces of oil storage tanks, transfer piping, heat exchangers, pipelines, and separators.

It is a still further object of the present invention to provide a method and apparatus capable of retorting materials such as coal, oil shale, peat, lignite, tar and oil sands, and sour crudes to remove moisture, sulfur, gases, ash and provide clean oil.

It is a still further object of the present invention to provide a method and apparatus for in situ separation and removal of hydrocarbons, sulfur, water and other constituents from geological substrates of coal, peat, lignite, oil shale, tar sand and oil.

It is a still further object of the present invention to provide a method and apparatus for decreasing the pour point of a hydrocarbon fluid.

It is a still further object of the present invention to provide a method and apparatus for removing rust and scale from the metal surfaces of storage vessels.

It is a still further object of the present invention to create an automatic insulating layer as required for a storage vessel from the hydrocarbon fluid present in the vessel and eliminate the need to externally insulate the storage vessel.

It is a still further object of the present invention to provide a method and apparatus for separating oil from an oil, sediment and water hydrocarbon fluid emulsion to effectively de-emulsify and desulfurize the hydrocarbon fluid.

It is a still further object of the present invention to provide a method and apparatus which produces a high quality char from coal and petroleum coke.

It is a still further object of the present invention to provide a method and apparatus for cleansing hydrocarbon and other fluids of bacteria and algae.

It is a still further object of the present invention to provide a method and apparatus for increasing the yield of hydrogen from coal.

It is a still further object of the present invention to provide a method and apparatus for dewatering coal slurry.

It is a still further object of the present invention to provide a method and apparatus for removing a desired hydrocarbon, such as acetone, from water.

It is a still further object of the present invention to provide a method and apparatus for in situ recovery of fractions from hydrocarbon material which minimizes energy loss during the recovery.

It is a still further object of the present invention to provide a method and apparatus for reconstituting drilling mud.

Briefly, in accordance with the present invention, a method and associated apparatus is provided for recovering fractions from hydrocarbon material, including the steps of generating electromagnetic energy generally in the frequency range of from about 300 megahertz to about 300 gigahertz, in accordance with the lossiness of the material transmitting the generated electromagnetic energy to the hydrocarbon material, exposing the hydrocarbon material to the electromagnetic energy for a sufficient period of time to sequentially separate the hydrocarbon material into fractions, and removing the resulting fractions. However, it should be understood that a plurality of frequencies within the afore-mentioned frequency range or in combination with frequencies outside this range may be utilized in accordance with the lossiness of the fractions to be removed. Advantageously, the temperature of the high viscosity hydrocarbon fluid may be precisely controlled by changing the broadcast location for the electromagnetic energy to effectively sweep the hydrocarbon fluid to optimize oil production while decreasing its viscosity to facilitate its separation and removal from a vessel. Further, the electromagnetic energy may be used to clean storage vessels of scale and rust and a metal shield can be placed in the storage vessel to effectively create an insulating layer for the storage vessel from a portion of the hydrocarbon fluid present in the vessel. It should be understood that in addition to use with land, air and sea vessels, including pipelines, the present invention is also useful for underwater, underground and in situ subsurface applications. Moreover, a plurality of RF frequencies spaced far enough apart to preclude wave cancellation and having varying field strengths may be used simultaneously in accordance with their absorptivity by the various fractions to be recovered so as to achieve maximum efficiencies in recovering the fractions.

Other objects, aspects and advantages of the present invention will be apparent from the detailed description considered in conjunction with the drawings, as follows:

DETAILED DESCRIPTION

In the course of using electromagnetic energy to heat hydrocarbon materials to increase their fluency, applicant has discovered that with continued exposure to electromagnetic energy the fractions present within the hydrocarbon material sequentially separate out at different points in time providing purified or clean oil. Therefore, water, acids, sulfur, chlorides, sediment and metals can be readily separated and easily removed from the hydrocarbon materials. This separation occurs as a result of the varying ability of these materials to absorb electromagnetic energy at different frequencies due to the differences in the dielectric constants and loss tangents and therefore the lossiness of the materials. Advantageously, by controlling the period of time during which the hydrocarbon material is exposed to electromagnetic energy and/or varying the frequency and field strength thereof, the desired fraction or fractions can be most efficiently separated from the residual hydrocarbon material.

The residual products which remain after removal of oil, gases, sulfur and condensates from coal with electromagnetic energy are coke and ash. The yield of hydrocarbon resulting from the present invention has been found to be much greater than that produced by conventional heating techniques. The coke may be removed at a later date for use in metal processing or for the production of briquettes. The quality of the char resulting from heating coal and petroleum coke in accordance with the present invention is generally far superior to that which is produced with conventional methods.

Further, it has been found that the temperature of a hydrocarbon fluid having a kinematic viscosity in the range of about 20 seconds Saybolt Universal to about 500,000 seconds Saybolt Universal at 100° F. can be more effectively controlled to maximize production, minimize energy costs and prolong the life of the magnetron filament by controlling the broadcast location of the electromagnetic energy. It has also been found that scale, rust and paraffin can be removed from metal surfaces in storage vessels by employing electromagnetic energy in accordance with the present invention. It also has been discovered that the pour point of the oil which results from exposing the hydrocarbon fluid to electromagnetic energy in accordance with the present invention is lower than that produced by conventional heating techniques. Advantageously, the present invention may also be utilized to automatically create a layer of insulation for a storage vessel from the hydrocarbon fluid present therein, as required by ambient temperature conditions.

Figure 1:
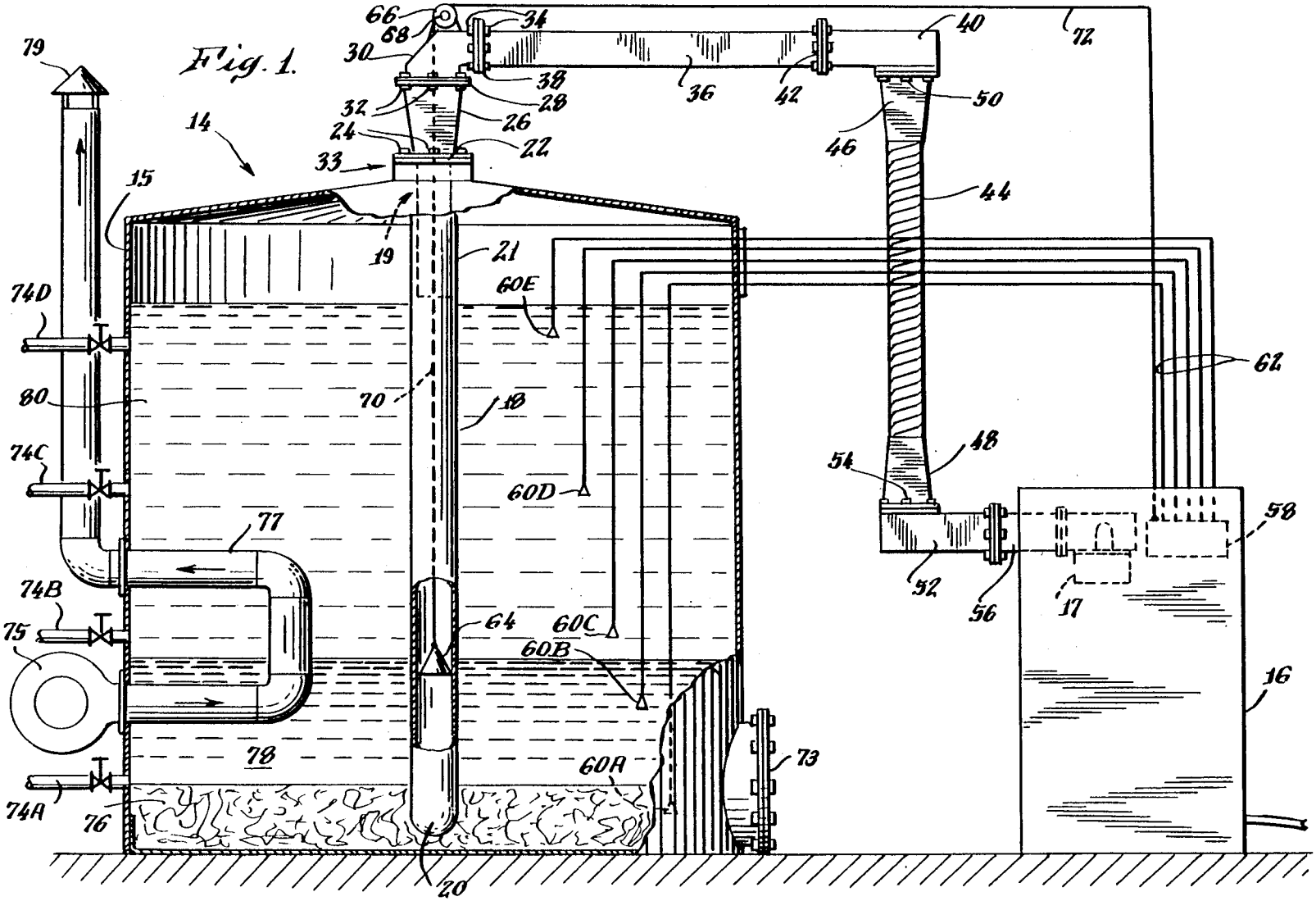
FIG. 1 is a side elevational view, with parts broken away, of an apparatus in accordance with the present invention for providing clean, separated oil from hydrocarbon fluids stored in vessels.

Referring to FIG. 1, an apparatus in accordance with the present invention is generally illustrated at 14 for use with a vessel or open or closed top oil storage tank 15 or mud pit. The hydrocarbon fluid, such as oil, stored in the tank 15 often contains water, sulfur, solids and other undesired constituents or contaminates, including bacterial and algae, as well as scale and rust, all of which may be considered as basic sediment. Moreover, during storage, the contamination and viscosity of the oil will often increase to the point where the LACT (Lease Acquisition Custody Transfer) measurement is often too great for pipeline acceptance. Advantageously, the apparatus 14 not only heats the oil to decrease its viscosity and increase its fluency, but also separates water, sulfur and basic sediment from the oil in the tank 15, resulting in clean oil. The exiting gases, including sulfur, may be collected via a collection line and holding tank (not shown) which are in communication with the top of the tank 15.

The apparatus 14 includes a radio frequency (RF) generator 16 which includes a magnetron 17 or klystron, or other similar device, such as a solid state oscillator as disclosed in the aforementioned reissue patent, which is capable of generating radio waves in the frequency range of from about 300 megahertz to about 300 gigahertz and generally utilizing from 1 KW to 1 MW or more of continuous wave power. However, it should be understood that a plurality of magnetrons 17 or oscillators, or a klystron may be used to generate a plurality of heating frequencies which are far enough apart to prevent interference and which may have greater absorptivity to certain fractions which it is desired to remove. In this regard, the oscillator may be further modified or another oscillator may be provided to generate a frequency outside of this range for use with the aforementioned frequencies in accordance with the lossiness of the fractions to be removed. The magnetron 17 is mechanically coupled to an applicator 18 which is transparent to radio waves in the aforementioned frequency range. Advantageously, the applicator 18 is in the shape of an elongated tube with an open upper end 19 and a closed bottom end 20. The applicator 18 is preferably constructed from resin with glass fibers, fused alumina, silicon nitride or similar radiotransparent materials so that it is permeable to RF waves in the desired frequency range but impermeable to liquids and gases. The applicator 18 is attached, e.g., by means of glass cloth and epoxy resin, to a tubular metal waveguide 21, constructed of aluminum or nickel and iron, which passes through metal tank cover 22. The tank cover 22 is bolted and grounded to the tank 15 by a plurality of nuts and bolts indicated at 24.

A metal transition member 26, which includes a flanged end 28, is bolted to one end of 90° metal elbow 30 by bolts and nuts 32. The tubular end 33 of the transition member 26 is attached to the tubular waveguide 21, e.g., by welding, threading or flanging, as desired. The other end 34 of the 90° elbow 30 is bolted to one end of rectangular metal waveguide portion 36, which may be formed of 6061-T6 aluminum by nuts and bolts 38.

The other end of the rectangular waveguide 36 is coupled to WR x coaxial transition member 40 with nuts and bolts 42. Flexible coaxial member 44, which may have its inner and outer conductors constructed of copper with polyethylene covering, is fitted with flanged ends 46 and 48 which advantageously have internal gas barriers to allow the flexible coaxial member 44 to be charged with an inert gas refrigerant, such as Freon, to increase its power carrying capacity while preventing the flow of any gases emanating from the hydrocarbon fluid back into the RF generator 16, which may result from a rupture or leakage in the applicator 18. Flanged end 46 is coupled to the WR x coaxial transition member 40 with bolts and nuts 50 and flanged end 48 is coupled to coaxial x WR transition member 52 with bolts and nuts 54. The flanged end of the coaxial x WR transition member 52 is coupled to the RF generator 16 through a rectangular extension portion 56 which receives the electromagnetic energy generated by the magnetron 17.

A controller 58 controls the energization of the RF generator 16 and receives signals from a plurality of temperature sensors 60 A–E arranged within the tank 15. The controller 58 may be coupled to the sensors 60 A–E by interconnection wires or by fiberoptic transmission lines 62, as desired. The sensors 60 A–E are advantageously vertically spaced at predetermined intervals or locations within the tank 15.

A generally conically shaped energy deflector 64 is arranged within the applicator 18 for upward and downward movement to control the broadcast locations for the electromagnetic energy propagated through the applicator 18. This upward and downward movement is provided by a motor 66 which drives a pulley 68 causing it to wind or unwind cable 70 attached to the energy deflector 64, thereby controlling the vertical broadcast location of the deflector 64 within the tank 15. However, as desired, a separate frequency may be transmitted through the waveguide 36 to activate the motor 66. Preferably, the energy deflector 64 is initially located near the bottom of the applicator 14, i.e., at the bottom of tank 15, and moved gradually upward since the lighter oil will tend to rise to the top and the heavier water will sink to the bottom of the tank 15.

Advantageously, by broadcasting the energy in this manner, the magnetron 17 may run continuously at full power to operate at the greatest efficiency, the temperature at various layers within the hydrocarbon fluid can be effectively controlled, so that the production of oil is maximized, and the life of the anode or filament of the magnetron 17 is prolonged.

The motor 66 is connected to a power source (not shown) through controller 58 by line 72. The controller 58 activates the motor 66 to move the deflector 64 thereby changing the broadcast location for the electromagnetic energy in response to the temperatures sensed by sensors 60 A–E. Further, the frequency and period of application of the electromagnetic energy is controlled by the controller 58 which may be preset or programmed for continuous or intermittent upward and downward cycling to achieve homogeneous heating of the hydrocarbon fluid or localized heating, as desired, to achieve the highest yield or best production of oil at minimum energy cost. The broadcast location of the energy deflector 64 may be preset to provide predetermined controlled continuous or intermittent sweeping of the electromagnetic energy through the hydrocarbon fluid by employing a conventional timer and limit stops for the motor 66.

Advantageously, valves 74 A–D may be located in the vertical wall of the tank 15 to draw off the oil after the treatment with electromagnetic energy has been completed. After heating with electromagnetic energy in accordance with the present invention, the results are illustrated in FIG. 1. Near the bottom of the tank 15 is a layer which is essentially basic sediment and water, designated as 76. Above the bottom layer 76 is an intermediate layer designated 78 which is a mixture of mostly oil with some basic sediment and water. Finally, above the layer 78 is a top layer designated 80 which represents the resulting oil which has been cleansed and is free of basic sediment and water. Located in the sidewall of the tank 15 near its bottom is an access hatch 73 for removing the resulting basic sediment, which may include "drilling mud" solids. Advantageously, any bacteria and algae present in the hydrocarbon fluid are disintegrated by the RF waves, with their remains forming part of the basic sediment.

To further aid circulation and cleansing of the layer of oil 80, a conventional conduction heater, such as a gun barrel heater 75 may extend into the tank 15. This heater 75 which may be gas or oil driven, circulates hot gases through piping 77 to provide a low cost source of BTUs to further heat the oil once the water and basic sediment has been separated from the oil and the oil is sufficiently liquified or fluid for convection currents to flow. (Steam coils may be used as an alternative, as desired.) These convection currents further aid in reducing the viscosity of the oil and removing fine sediment. A spark arrester 79 is provided in the piping 77 to eliminate any sparks in the exiting gases. Further, the cleansed oil may be passed through a Teflon filter to remove any remaining fine sediment therefrom as a cake.

Oil which is extracted from well bores often contains a considerable amount of basic sediment and water, and possibly a high concentration of paraffin as well. These undesirable constituents present a major for the oil industry because the oil must meet certain minimum API specifications, such as compliance with LACT measurements, before it can be transferred to a pipeline for refining or distribution. Heater treaters, separators, expensive chemicals and filters have been used to meet these minimum specifications with a limited degree of success.

By utilizing the method and apparatus of the present invention, clean oil is readily and easily separated from basic sediment and water. This is accomplished by heating the hydrocarbon fluid in the tank 15 with electromagnetic energy which causes the water molecules which are normally encapsulated within the oil to expand rupturing the encapsulated oil film. It is difficult to heat the encapsulated water by conventional conduction or convection techniques because the oil functions as an insulator. However, such heating can be readily accomplished with radio frequency waves because water has a greater dielectric constant and greater loss tangent than oil, which results in a high lossiness, thereby allowing it to absorb significantly more energy than the oil in less time resulting in rapid expansion of the volume of the water molecules within the oil film, causing the oil film to rupture. The water molecules then combine into a heavier than oil mass which sinks to the bottom of the tank, carrying most of the sediment present in the oil with it. However, to further facilitate removal of the basic sediment, particularly fines, brine or salt water may be spread across the surface of the top layer of oil 80 after the viscosity of the oil 80 has been lowered, through heating with electromagnetic energy in accordance with the present invention. The heavier salt water will rapidly gravitate through the layer 80 of oil toward the bottom of the tank 15, carrying the fine sediment with it.

Layers 76, 78 and 80 have resulted from treating hydrocarbon fluid containing oil, basic sediment and water stored in tank 15, by sweeping the fluid with electromagnetic energy in accordance with the apparatus in FIG. 1 having a power output of 50 KW for approximately 4 hours. However, it should be understood that the power output and time of exposure will vary with the volume of the tank 15, the constituents or contaminates present in the hydrocarbon fluid, and the length of time during which the hydrocarbon fluid has been stored in the tank 15.

Since hydrocarbons, sulfurs, chlorides, water (fresh or saline), and sediment and metals remain passive, reflect or absorb electromagnetic energy at different rates, exposure of the hydrocarbon fluid to electromagnetic energy in accordance with the present invention will separate the aforementioned constituents from the original fluid in generally the reverse order of the constituents listed above. Further, acids and condensable and non-condensable gases are also separated at various stages during the electromagnetic energy heating process. For Bayol the optimum frequencies for separation according to the lossiness of the oil in descending order are 10 GHz, 100 Hz and 3 GHz; for Diala Oil the optimum frequencies for separation in descending order are 25 GHz, 10 GHz, 300 MHz, 3 GHz and 100 MHz. For water, both temperature and the frequency are significant for absorption of RF energy. The optimum frequencies, loss tangents and boiling points for the various fractions present in the hydrocarbon material which it is desired to recover can be obtained from Von Hippel, *TABLES OF DIELECTRIC MATERIALS,* (1954) published by John Wiley & Sons, Inc., and *ASHRAE HANDBOOK OF FUNDAMENTALS,* (1981), published by the American Society of Heating, Refrigerating and Air Conditioning Engineers, Inc.

Figures 2, 3, 4, 5, 6:
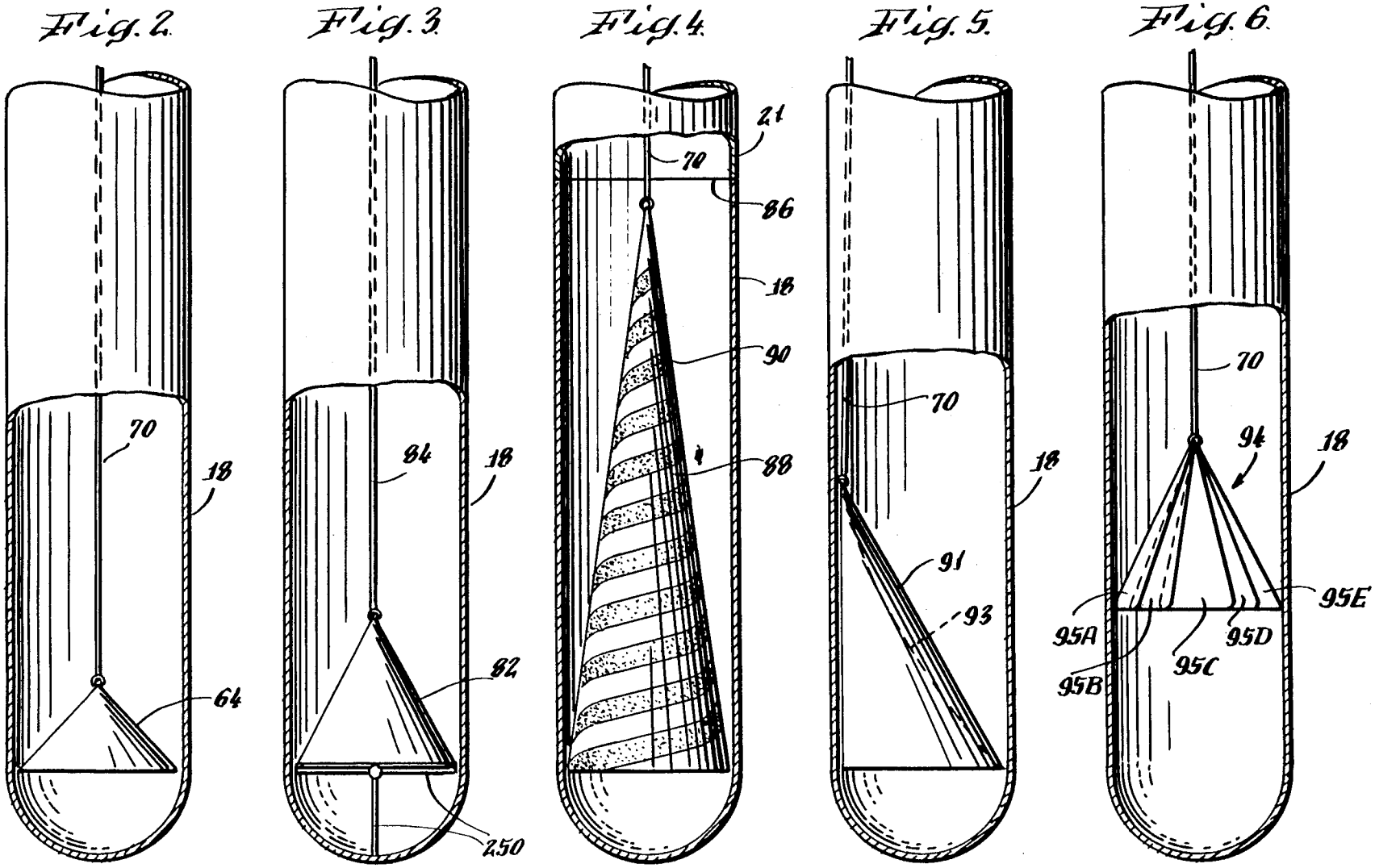
FIG. 2 is an enlarged side elevational view of one form of energy deflector which may be used in the apparatus of FIG. 1 or in subsurface applications.
FIG. 3 is an enlarged side elevational view of another embodiment of an energy deflector which may be used in the apparatus of FIG. 1 or in subsurface applications.
FIG. 4 is an enlarged side elevational view of another embodiment of an energy deflector which may be used in the apparatus of FIG. 1 or in subsurface applications.
FIG. 5 is an enlarged side elevational view of another embodiment of an energy deflector which may be used in the apparatus of FIG. 1 or in subsurface application.
FIG. 6 is an enlarged side elevational view of another embodiment of an energy deflector which may be used in the apparatus of FIG. 1 or in subsurface applications.

Referring to FIG. 2, the applicator 18 and energy deflector 64 are shown enlarged relative to that illustrated in FIG. 1. The deflector 64 is suspended within the applicator by the dielectric cable 70 which is constructed of glass fibers or other similar radiotransparent materials which are strong, heat resistant and have a very low dielectric constant and loss tangent. The height of the energy deflector 64 will determine the angle of deflection of the electromagnetic energy.

Referring to FIG. 3, an alternative embodiment for the deflector 64 shown in FIG. 1 is illustrated as 82. The deflector 82 has a greater angle of deflection (lesser included angle) than the deflector 64 to cause the deflected waves to propagate from the applicator 18 in a slightly downward direction below a horizontal plane through the deflector 82. This embodiment enables the radio frequency to penetrate into payzones which may be positioned below the end of a well bore, when the method and apparatus is utilized for in situ heating in a geological substrate.

The energy deflector 82 is suspended by a fiberoptic cable 84 which not only facilitates movement of the RF deflector 82, but also provides temperature readings. In this respect, the individual fiberoptic strands 83 of the fiberoptic cable 84 are oriented to detect conditions at various locations in a vessel or borehole. The information transmitted to the remote ends of the fiberoptic strands 83 can be converted into a digital readout with an analog to digital converter for recording and/or controlling power output levels as well as for positioning the deflector 82. For example, it may be desired to provide a vertical sweep pattern of the RF energy in response to the temperature gradients sensed by the fiberoptic strands 83. Advantageously, the frequency for use with the fiberoptic strands 83 is selected to be sufficiently different from the frequency of the RF generator 16 to prevent interference or cancellation.

Referring to FIG. 4, the radiotransparent applicator 18 is shown coupled to waveguide 21 by brazing for for downhole applications where the high temperatures encountered would be detrimental to fiberglass. Advantageously, the waveguide 21 may be an alloy of 42% nickel with the remainder being iron and the applicator 18 may be formed from 995 alumina metallized with molydenum manganese or from silicon nitride. The brazing material 86 which may be, e.g., 60% silver, 30% copper and 10% tin, is applied between the applicator 18 and the waveguide 21. Arranged within the applicator 18 is another embodiment of an energy deflector designated 88 which is constructed of pyroceram or other similar dielectric material with a helical or spiral band of reflective material 90, such as stainless steel, which is wound around the ceramic material of the conically shaped deflector 88 from its base to its apex for the purpose of broadcasting a wide beam of RF energy over a large vertical layer in a wellbore or vessel in order to broadcast over a greater volume of the hydrocarbon fluid with less concentrated energy, in effect diffusing the electromagnetic energy to provide an energy gradient. Advantageously, instead of providing the aforementioned band of metal 90, a spiral portion of the alumina or silicon nitride energy reflector 88 may be sintered and metallized to provide the desired reflective band by conventional vacuum deposition techniques.

It should be understood that other means may be employed to raise and lower the deflector to accomplish the sweeping function, including hydraulic, vacuum, air pressure and refrigerant expansion lifting systems. Further, the waveguide coupling from the RF generator 16 may also be utilized to send control signals from the controller to the motor or other mechanism for raising and lowering the RF deflector. However, it should be understood that the frequency for such control signals must be selected to be sufficiently different from the frequency or frequencies selected for the electromagnetic energy which heats the hydrocarbon fluid to prevent interference or cancellation. Thus, the waveguide coupling can be utilized to carry signals having different bandwidths without having one frequency interfere with another. For example, an oscillator may be coupled to the waveguide to provide K band frequency for temperature sensing while C bank frequency is generated by the RF generator 16 for heating the hydrocarbon fluid.

Referring to FIG. 5, another form of energy deflector is indicated at 91. This deflector 91 is essentially a right angle triangle in cross section with a concave surface 93 for focusing all of the deflected electromagnetic energy in a particular direction to heat a predetermined volume in a vessel or a particular payzone or coal seam in subsurface applications.

Referring to FIG. 6, another form of energy deflector is indicated at 94. This deflector 94 includes interconnected segments 95A–95D which provide one angle for deflection of the electromagnetic energy when the deflector is abutting the applicator 18, as shown in FIG. 6, and another angle of deflection for the electromagnetic energy when the cable 70 is pulled upwardly causing the segments 95A–95D to retract. However, it should be understood that other means may be employed to change the angle of deflection of the deflector 94, such as a remote controlled motor.

The disposal of drilling fluids known as "drilling mud" has become a severe problem for the oil industry. Advantageously, the apparatus shown in FIG. 1, modified to incorporate any of the energy deflectors illustrated in FIGS. 2–6, may be utilized to reconstitute drilling mud for reuse by application of radio frequency waves to remove the excess liquids and leave a slurry of bentonite, barite salts, etc. If desired, some of the chemical additives, as well as water and oil, can be reclaimed in this manner from the mud and well bore cuttings by removing substantially all of the liquids. The removed water which is in the vapor or steam phase may be compressed into high pressure steam suitable for running a turbine to generate electricity.

Figure 7:
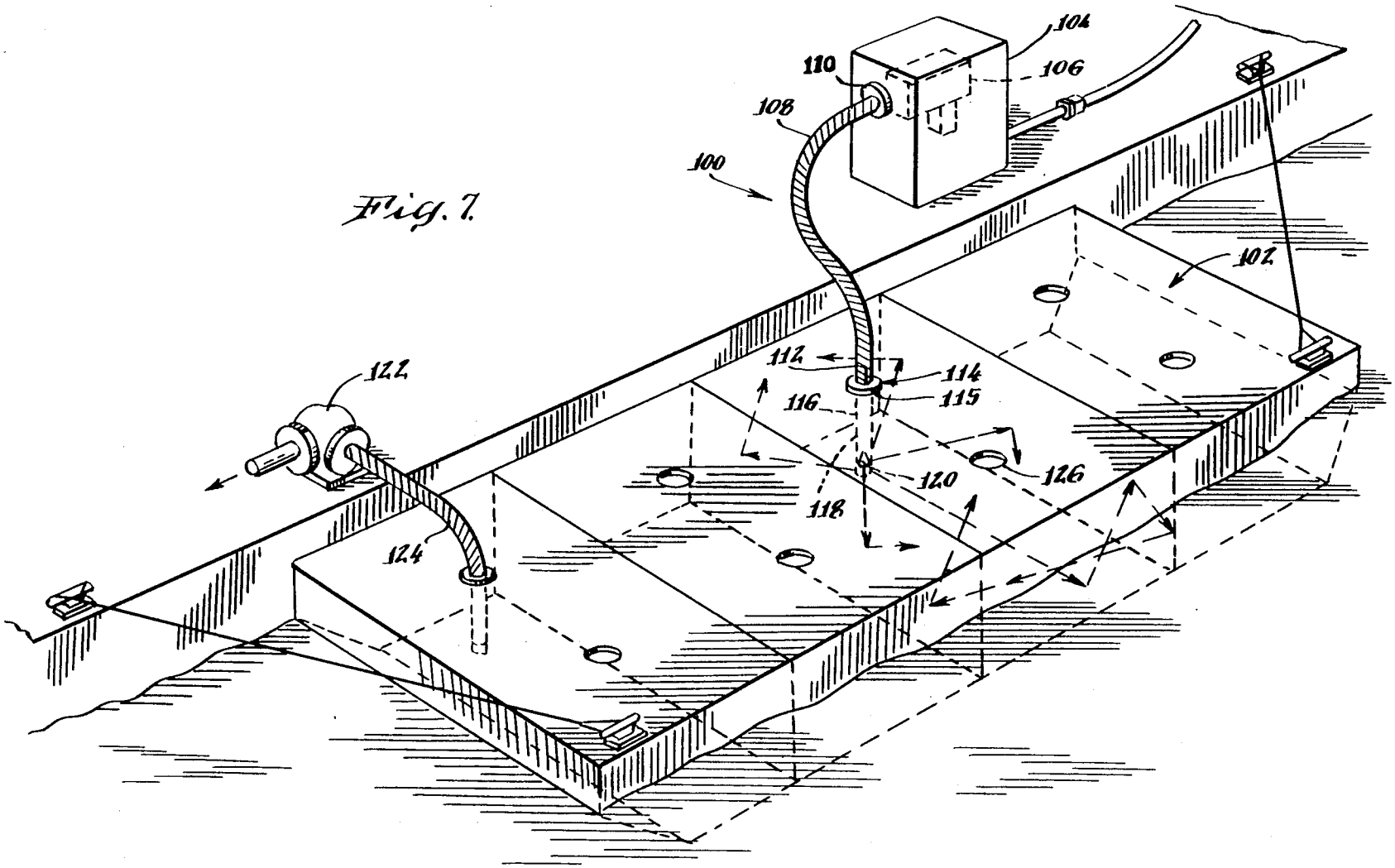
FIG. 7 is a perspective view of an apparatus in accordance with the present invention for increasing the fluency of high viscosity oil and sludge found in the hold of a vessel, here illustrated as a barge.

Referring to FIG. 7, apparatus in accordance with the present invention, designated as 100, can be advantageously employed to remove high viscosity hydrocarbon fluid or sludge from vessels, such as oil tankers or barges 102. A mobile RF generator 104, which includes an oscillator, klystron or magnetron 106, has attached thereto at its output 110 a flexible coaxial waveguide 108 which may be formed of copper. The other end 112 of the flexible coaxial waveguide 108 extends through a manhole cover sealing connection 114 position in a manhole 115 in the barge 102. The sealing connection 114 is fluid tight to seal against the escape of liquids and gases and also radio frequency tight to prevent the escape of RF energy when the sealing connection 114 is positioned in the manhole 115. Typical power supplied to the RF generator 106 may be 480 V, 3 phase, 60 Hz at 100 amps. The flexible waveguide 108 is affixed at its other end to a tubular waveguide 116 which in turn is attached to a radiotransparent applicator 118. Positioned within the applicator 118 is an energy deflector 120 which is capable of upward and downward broadcast movement, as desired, and may be of any one of the types disclosed in FIGS. 2–6. A suitable mechanism for moving the energy deflector 120 upwardly and downwardly, such as disclosed in FIG. 1, is employed. Moreover, it is advantageous to provide inert gas shielding for the flexible coaxial waveguide 108 as disclosed with reference to FIG. 1.

The oil heated by RF waves may be removed from the respective compartment of the barge 102 by a suction pump 122 for storage in a tank (not shown). The pump 122 has a flexible hose 124 which is positioned within a second manhole 126 in the same compartment for extraction of the heated oil. For clarity, the pump 122 and hose 124 are shown positioned in a manhole of another compartment, although it should be understood that oil can be removed from the compartment being heated, as desired.

The arrows emanating outwardly from the deflector 120 and the applicator 118 indicate a typical pattern for the radio frequency waves. As the waves leave the radio-transparent applicator 118 they are absorbed by the oil/ water mixture or penetrate slightly into the inner tank skin of the sidewalls heating the oil trapped in the pores where they are absorbed or reflected by the metal walls of the compartment until all of the RF energy is eventually converted into heat in the hydrocarbon fluid. It should be understood that although the present invention is illustrated in FIG. 7 for use with a barge it can be used with any type of ship, vessel or enclosure.

Moreover, it has also been discovered that the rust and scale buildup on the walls of oil tanker or barge compartments can be removed, leaving bare metal walls, by employing the method and apparatus of the present invention. In this regard, when condensation results in oxidation of the steel walls of a compartment, a film of water is trapped under the resulting layer of rust or scale. By directing RF energy to the walls, this water film is heated and expands forming steam which causes the scale or rust layer to flake off in large sheets, similar to parchment with the corners curled inward, until a clear base metal surface is left. The removed rust or scale settles to the bottom of the vessel as basic sediment. It should be understood that this technique can also be utilized to clean other metal surfaces, including condenser tubes and the like.

Figure 8:
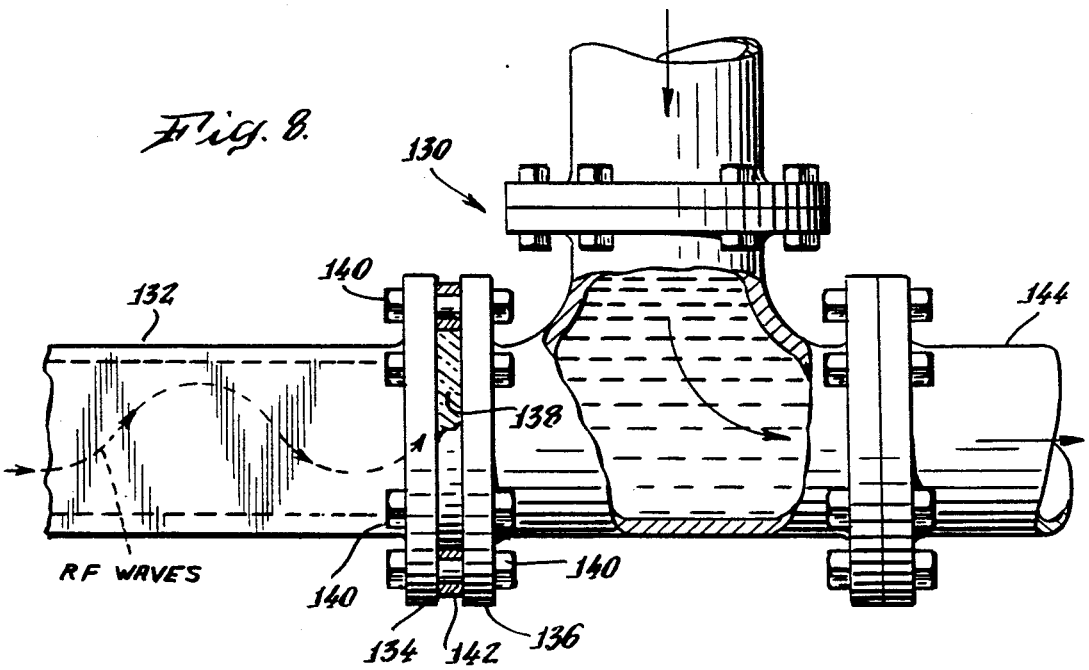
FIG. 8 is a side elevational view of an apparatus in accordance with the present invention for increasing the fluency of oil in a pipeline.

Referring to FIG. 8, the present invention is shown for use with an oil pipeline, specifically with a T connection indicated at 130; the oil flow is as illustrated by the solid arrows. However, it should be understood that the present invention may be used with any pipeline including an offshore oil rig. A waveguide 132 having a flanged end 134 is coupled to a mating flange 136 of the T connection 130. A radiotransparent sealing disc 138, such as silicon nitride, is sandwiched between the flanges 134 and 136 by bolts and nuts 140. A metal RF shield ring 142 is arranged circumjacent the sealing disc 138 and sandwiched between the flanges 134 and 136. This RF shield ring 142 prevents the loss of RF waves which are propagated along the waveguide 132 and through the radiotransparent sealing disc 138 into the T connection 130. The RF waves propagate through the oil in the T connection 130 and through the oil in the pipeline 144. Advantageously, such an arrangement heats the oil to decrease its viscosity, thereby requiring less pumping energy to drive the oil through the pipeline 144, and further cleans the walls of the T connection 130 and pipeline 144 of paraffin causing the same to homogenize and remain in solution.

Figure 9:
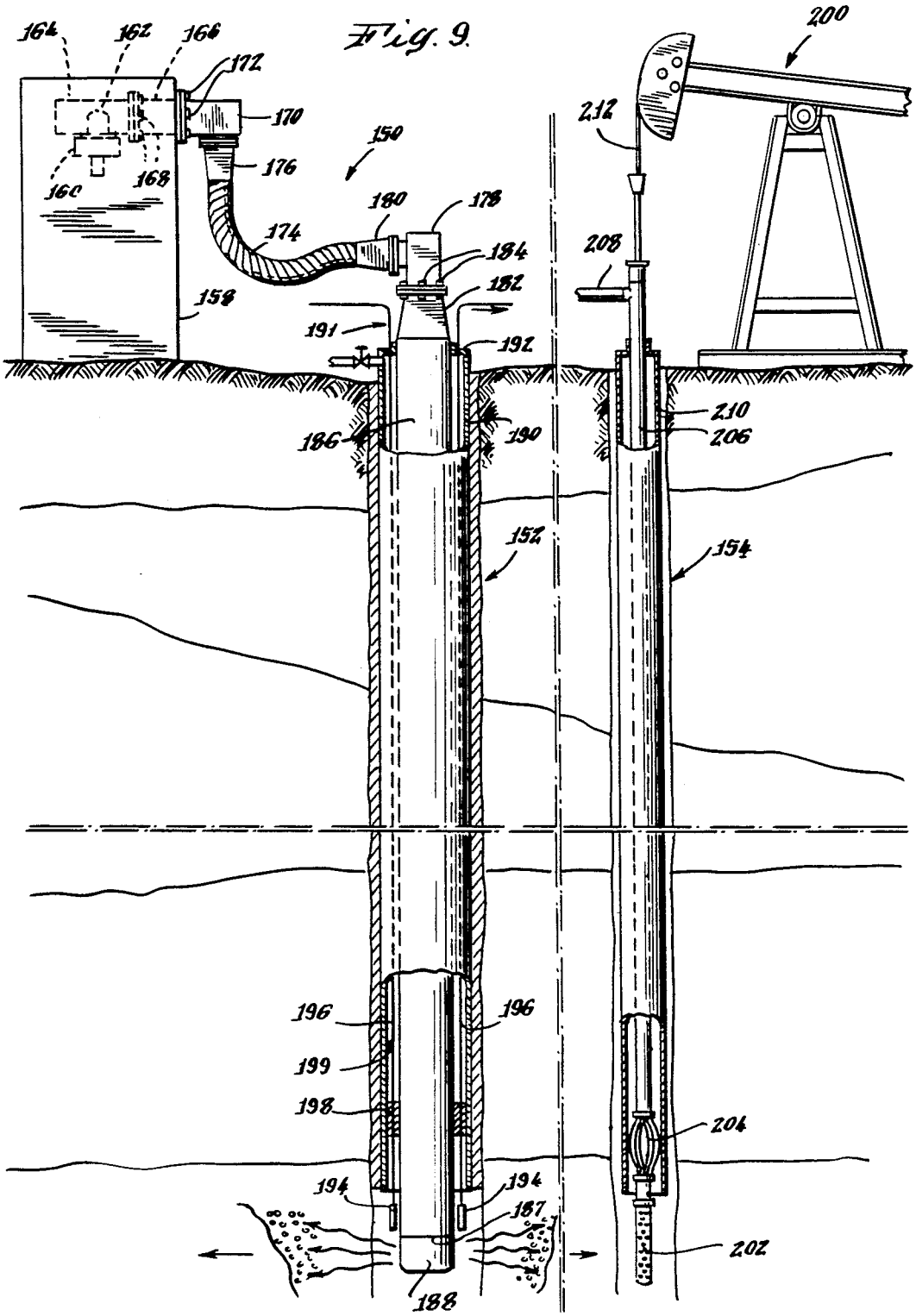
FIG. 9 is a side elevational view, with parts broken away, of an apparatus in accordance with the present invention for in situ recovery of hydrocarbons from hydrocarbon material.

Referring to FIG. 9, an apparatus in accordance with the present invention, designated as 150, is shown positioned in an injection well 152 which is located adjacent at least one producing well 154. The apparatus 150 includes an RF generator 158 which is electrically coupled to a power source (not shown) which supplies 3 phase, 460 V, 60 Hz current thereto. A magnetron 160 positioned within the RF generator 158 radiates microwave energy from an antenna or probe 162 into waveguide section 164 for propagation. A waveguide extension 166 has one end coupled to the waveguide section 164 with bolts and nuts 168 and its other end coupled to a waveguide to coaxial adapter 170 with bolts and nuts 172. A flexible coaxial waveguide 174, e.g., copper, is coupled at one end to the adapter 170 through a gas barrier fitting 176. The other end of the flexible waveguide 174 is coupled to a coaxial to waveguide adapter 178 through a gas barrier member 180. A transformation member 182 is coupled at one end to the adapter 178 with bolts and nuts 184. The other end of the transformation member 182 is coupled to a tubular waveguide 186, which may be, e.g., at 915 MHz, 10 inches in diameter, for instance by welding. A radiotransparent applicator 188 is attached to the tubular waveguide 186 at 187, e.g., by brazing, for withstanding the high temperatures encountered in downhole applications. The applicator 188 and energy deflector (not shown) may include any of the types illustrated in FIGS. 2–6 for broadcasting RF waves. Further, the energy deflector will be coupled to a raising and lowering means, e.g., of the type illustrated in FIG. 1.

The waveguide 186 is positioned within a casing 190 formed in the well 152. The well head 191 is capped by a sealing gland 192 which effectively seals the waveguide 186 therein. A plurality of thermocouples 194 are positioned in the well 152 between the casing 190 and the waveguide 186 and extend to a location adjacent the bottom of the well 152. Leads 196 connect the thermocouples 194 to a controller (not shown). The leads 196 extend through a packer seal 198 arranged between the waveguide 186 and casing 190 near the bottom of the well 152. However, the packer seal 198 would not be used if it is desired to produce the resulting oil, water and gases through the annular space 199 between the casing 190 and waveguide 186. Alternatively, in the absence of the packer seal 198, the expansion of the oil, water and gases will drive the same up through the annulus 199 until the constituents in the immediate vicinity of the applicator 188 are removed. Subsequently, the annulus 199 can be packed off with the packer seal 198 and the hydrocarbons further heated to drive the resulting oil, water and gas to the producing well 154. For example, if the temperature of the oil is increased to 400° F., there is approximately a 40% increase in the volume of the oil.

The RF energy emanating from the applicator 188, as represented by the arrows, will heat the hydrocarbon material in the geological substrate causing the release of water, gases, and oil, with the hot oil, water and gas flowing into the bottom of the producing well 154 after the deflected RF energy melts sufficiently through the solidified oil to establish a flow path or communication path to the producing well 154. The volume increase in oil and water as a result of heating with RF energy further aids in establishing such a flow path. The pump set 200 of the producing well 154 pumps the oil, water and gas mixture through a perforated gas pipe 202, centered in the well casing 210 by centralizer 204 and production string 206 located in well casing 210 to a takeout pipe 208. Specifically, the pump set 200 moves a sucker rod 212 up and down in the production string 206 to draw oil, water and gas through the production string 206 into the take-out pipe 208 for transmission to a desired oil treating facility, such as a storage tank (not shown). This storage tank may also include an apparatus in accordance with the present invention, such as the apparatus shown in FIG. 1, to provide separation of the resulting constituents.

It should be understood that the injection well 152 illustrated in FIG. 9 may be fitted with supplementary drive means, such as pressurized steam or carbon dioxide for injection into the geological substrate through the annulus 199 formed between the well casing 190 and the waveguide 186 to aid in further heating the hydrocarbon material, but more importantly to drive the heated water, gas and oil to the producing well 154. Heating with electromagnetic energy will normally cause the resulting products to move upwardly in the annulus due to expansion of the oil, water and gas caused by heating. This expansion will continue until the volume increasing ability of the hydrocarbons in the immediate vicinity of the applicator 188 is exhausted. Thereafter, the annulus 199 can be packed or sealed off except for the supplementary drive means, e.g., a steam pipe (not shown), which extends therethrough. This approach aids in further reducing the viscosity of the resulting hydrocarbon fluid by providing externally heated steam in addition to the steam produced by heat expansion of the oil and the connate water in the formation. Carbon dioxide may be advantageously employed as the driving medium in those environments where it is not desired to introduce additional water (steam) which absorbs some of the RF energy, reducing its efficiency in heating the hydrocarbons.

Figure 10:
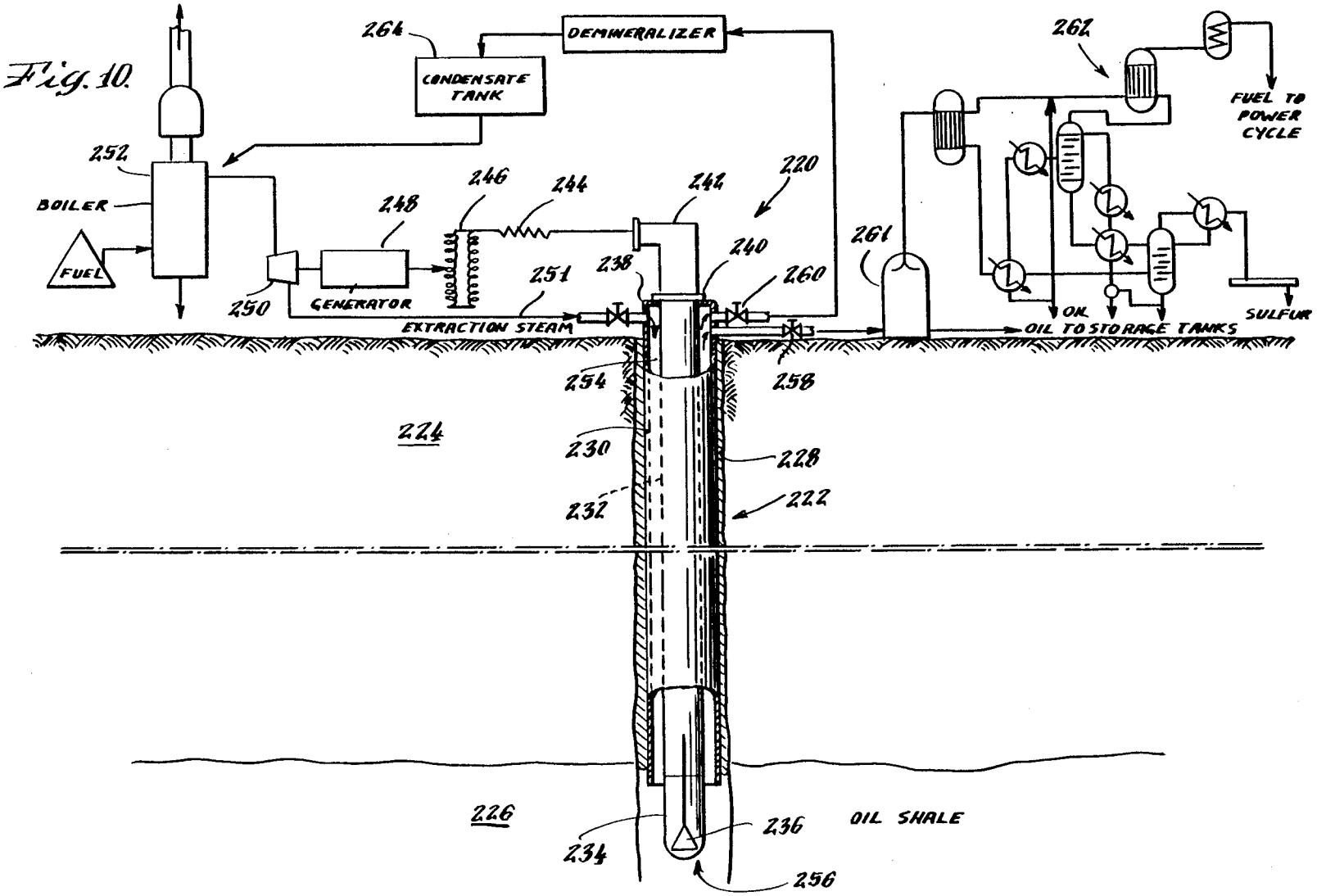
FIG. 10 is a schematic and side elevational view, with parts broken away, of an apparatus in accordance with the present invention for in situ recovery of fractions from oil shale, coal, peat, lignite and tar sands, showing the separation and scrubbing of the fractions.

Referring to FIG. 10, an apparatus in accordance with the present invention for in situ production of oil, gas water and sulfur from oil shale, coal, peat, lignite or tar sands by co-generation is illustrated generally at 220. Additionally, this arrangement may be readily utilized to supply additional electricity to local utilities. A well 222 is formed in the earth extending through the overburden 224 and into the bedding plane 226. The well 222 includes a cemented in steel casing 230 and a waveguide 232 positioned within the casing 230 and coupled to a radiotransparent applicator 234 housing an energy deflector 236, as described with reference to FIGS. 1–6. Means to raise and lower the energy deflector 236, as described with reference to FIG. 1 should be included, but the same has been eliminated for clarity. The waveguide 232 is affixed to the well head 238 with a packing gland seal 240 and to a transition elbow 242 which includes a gas barrier. Coupled to the remote end of the transition elbow 242 is a flexible coaxial waveguide 244 which is coupled to an RF generator 246 which includes a magnetion, klystron or solid state oscillator (not shown) for generating RF waves. Current is supplied to the RF generator 246 from an electric generator 248 driven by a turbine 250. High pressure steam is supplied to the turbine 250 from a boiler 252 which is preferably oil or gas fired, using as fuel the fuel oil or gas received from the well 222.

Low pressure extraction steam which exits from the turbine 250 is supplied to the annulus 254 between the casing 230 and the waveguide 232 in the well 222 by a steam line 251. The application of low pressure steam to the oil shale, coal, peat, lignite or tar sands, in addition to the RF energy serves to decrease the viscosity of the kerogen or oil in the formation, causing the water, oil and gas to expand and flow into the open hole sump 256, where it is forced upwardly under its own expansion and by the steam pressure to the surface with the oil and gas entering exit oil line 258 and the steam entering steam return line 260. The steam entering the steam return line 260 can be demineralized in demineralizer 262, condensed in condensate tank 264 and resupplied to the boiler 252, as desired.

The entering oil and gas is transmitted from the oil line 258 to a conventional liquid/gas separator 260. The separated oil is then transmitted to a storage tank for pipeline transmission, as desired. The gas is treated by a conventional cooler, saturator, absorber and desorber separating system 262 to produce additional oil, naphthalenes, phenols, hydrogen, and sulfur, as well as fuel oil for the boiler 252. In addition to producing its own fuel oil and water, the co-generation method and apparatus of FIG. 10 produces oil, gasoline, gas condensates and sulfur which can be further stored, sold or further used, as desired.

Figure 11:
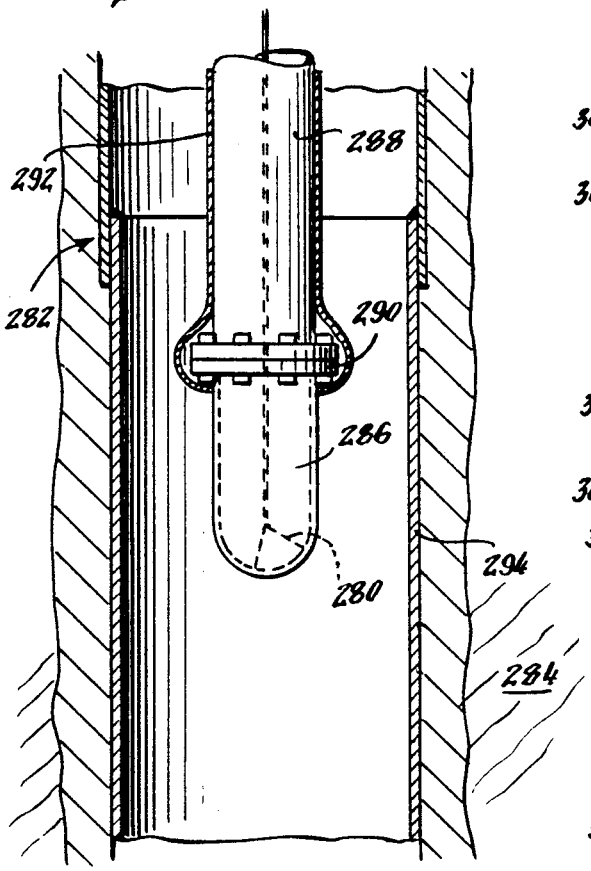
FIG. 11 is an enlarged view of an applicator and deflector in accordance with the present invention for in situ recovery of fractions from hydrocarbon material.

Referring to FIG. 11, a canted or angled energy deflector 280 is illustrated. The canted energy deflector 280 has a particular use in a well bore 282 in which the payzone 284 is inclined or offset relative to the well bore 282 so that the radio frequency energy can be directed to the seam or payzone 284. The deflector 280 is arranged at the bottom of an applicator 286 which is coupled to a waveguide 288 with an E.I.A. flange 290. A corrosion resistant covering 292 advantageously surrounds the waveguide 288 and flange 290. Extending downwardly from the casing 292 is a perforated liner 294 which is transparent to RF waves and protects the applicator 286.

Figure 12:
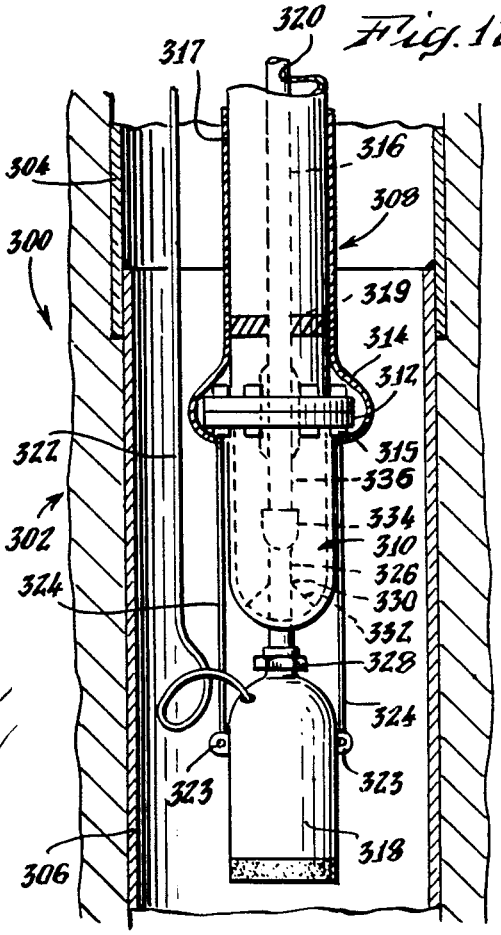
FIG. 12 is an enlarged view of a coaxial waveguide applicator, deflector and pump in accordance with the present invention for in situ recovery of fractions from hydrocarbon material.

Referring to FIG. 12, a coaxial waveguide arrangement is illustrated at 300 for in situ production of oil through a small diameter well bore 302. The well bore 302 includes a casing 304 and a perforated radiotransparent liner 306 which extends downwardly therefrom. A coaxial waveguide 308 is positioned within the well bore 302 and coupled to a radiotransparent applicator 310 with an E.I.A. flange 312. A fiberglass or other corrosion resistant covering 314 surrounds the waveguide 308 and the flange 312. The waveguide 308 includes a hollow central conductor 316 which is maintained in a spaced relationship from an outer conductor 317 with dielectric spacers 319, only one of which is shown. The hollow central conductor 316 extends through the applicator 310 for interconnection with a submersible pump 318 positioned within the liner 306. The interior of the central conductor 316 includes a fiberglass or polyethylene lining 320 to provide a production conduit through which oil is pumped to the surface. The oil pumped therethrough also helps to cool the inner conductor 316 by absorbing heat therefrom which in turn helps to maintain a lower viscosity in the producing oil by further heating it. Highly advantageous here is the cooling effect of the oil on the central conductor 316 which prevents overheating and dielectric breakdown of the dielectric spacers 319.

The pump 318 as shown in FIG. 12 is electrically driven, receiving power through a power cable 322. However, it should be understood that the pump 318 may be pneumatically or hydraulically operated if it is desired to eliminate the cable 322, e.g., in deep wells where too much friction may be present. Further, if desired, the pump 318 may be actuated by a magnetic field produced by RF waves which have a different frequency than that of the RF waves used for heating. The magnetic field can be used to rotate a magnetic drive mechanism to pump oil to the surface. Advantageously, the coaxial waveguide 308 is smaller in diameter than the waveguide illustrated in FIG. 11 to allow access to wells 302 having small diameter bores.

Preferably, the pump 318 is supported by support wires 324 or rods coupled between eyelets 323 affixed to the pump 318 and eyelets 315 affixed to the flange 312. A dielectric oil pipe 326 has one end coupled to the pump 318 with a flange 328 and passes through a central opening 330 in the energy deflector 332. A liquid tight seal, such as silcon nitride is applied therebetween. The other end of the oil pipe 326 is coupled to the central conductor 316 with a dielectric coupling member 334.

The electric field resulting from the propagation of the radio frequency waves through the waveguide 308 is attenuated along the central conductor 316. Normally, this attenuation would tend to overheat the dielectric spacers 319, eventually causing dielectric breakdown and arcing between the inner conductor 316 and outer conductor 317, and ultimately a breakdown of the coaxial waveguide 308. Advantageously, by having the oil pass through the inner conductor 316, the oil acts as a coolant to sufficiently cool the inner conductor 316 to eliminate the problem of overheating the dielectric spacers 319.

The RF waves propagated through the waveguide 308 are radiated or broadcast outwardly from the portion of the central conductor, designated 336, which functions as a $\frac{1}{4}$ wave monopole antenna. Any RF waves that travel past the antenna 336 are deflected by the energy deflector 332.

Figure 13:
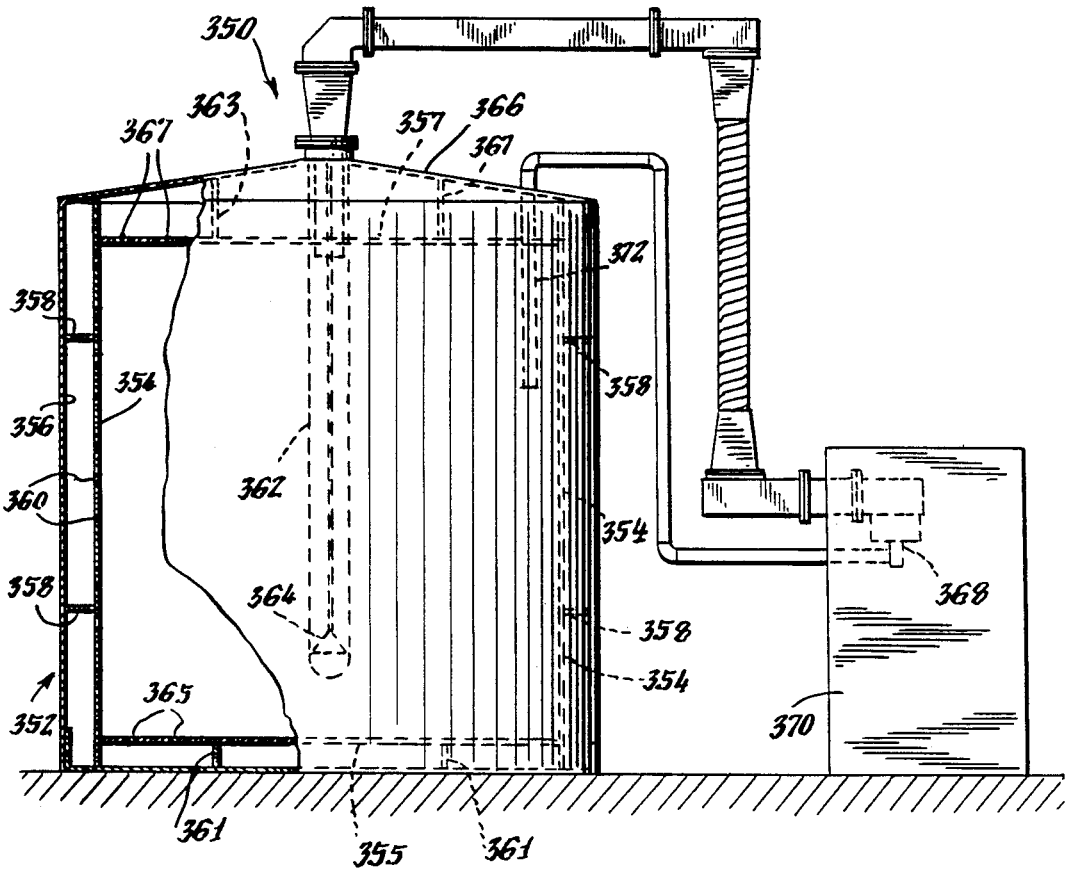
FIG. 13 is a side elevational view, with parts broken away, of a storage vessel including metal shields in accordance with the present invention for providing an insulating layer of hydrocarbon fluid.

Referring to FIG. 13, the present invention can be used in a vessel containing hydrocarbon fluid to effectively utilize a portion of the hydrocarbon fluid to provide an automatic layer of insulation for the vessel, as needed. One apparatus for accomplishing this function is generally illustrated in FIG. 13 as 350. It has been found that the resulting insulating value is often greater than the R value of the usual mineral or cellulose type insulators that are commonly used for this purpose. Conventional practice with large oil storage or day tanks, and particularly those used to store high viscosity No. 6 residual fuel oil (Bunker C), is to fit the same with heating coils and heater sets to maintain the oil in liquid form for transportation to a pipeline. A substantial amount of heat energy is lost through the metal walls and roof of the tank unless it is insulated. Such insulation is typically attached to the outer wall surfaces with stud welded clips. The insulation is then covered with a waterproof metallic lagging. However, during this covering process moisture is trapped between the tank walls and waterproof metallic lagging so that temperature variations between the enclosed space and ambient causes water vapor to condense on the tank walls. This leads to oxidation of the walls surface and eventual rust out. Thus, an uninsulated tank will normally last for a much longer period of time.

The method and apparatus of the present invention may be employed to provide a specific thickness of immobile oil in contact with and adjacent to the interior tank walls when the ambient temperature or temperature conditions are low. The R value of the insulation and the U factor will vary in accordance with the k factor of the oil. For No. 6 oil, the k factor is 0.070.

The tank 352 includes a perforated metal shield or wire mesh 354 arranged concentric with the tank side walls 356 and spaced interiorly therefrom a predetermined distance. The shield 354 is held at the required distance from the sidewall 356 by standoff brackets 358 which may be affixed therebetween by welding. Similarly, perforated metal shields 355 and 357 may be positioned a predetermined distance from the bottom surface 359 and top surface 366, respectively, as desired, Standoff brackets 361 and 363 may be arranged between the metal shield 355 and bottom surface 359 and metal shield 357 and top surface 366, respectively. The perforations 360, 365 and 367 in the shields 354, 355 and 359, respectively, are dimensioned relative to the amplitude of the RF waves to prevent the same from passing therethrough by causing them to encounter the metal shield and undergo reflections back therefrom.

During mild and warm temperature conditions, the oil can expand and contract without restriction and flow through the perforations 360, 365 and 367 so that it is available for use. However, when the temperature conditions are cold and the tank walls 356, 359 and 366 become cold, the viscosity of the oil will increase so that the oil will not be able to flow through the perforations 360, 365 and 367 and will tend to solidify inwardly toward the shields 354, 355 and 357 forming a thick insulation layer which is no longer capable of transferring external heat to the interior of the tank 352 by convection.

Apparatus in accordance with FIG. 1 may be utilized to maintain the fluency of the oil in the tank 352 which is located interiorly of the shields 354, 355 and 357. As illustrated in FIG. 13, it is preferred to introduce RF waves from the top of the tank 352 into a radiotransparent applicator 362 which is liquid tight at its bottom end. Such an arrangement insures against oil leakage from the tank 352 should the applicator 362 be damaged or fractured. The RF waves propagated through the radiotransparent applicator 362 are deflected into the oil by the energy deflector 364 where they are absorbed and converted into thermal energy. However, the RF waves will not penetrate beyond the shields 354, 355 and 357 but will be reflected back into the oil by shields 354, 355 and 357, if they have not already been absorbed. As desired, the shield 357 across the top surface 366 of the tank 352 may be eliminated since the heated oil when it cools will form a solid layer near the top surface 366. However, a small passage must be provided through this top solid layer for communication with the heated oil below to provide a vapor flow path to prevent implosion of the tank 352 should a void develop between the heated oil below and the oil that has solidified to form the top solid layer. One technique for providing such a liquid flow path is to provide piping 372 which transmits heat from the anode cooling system of the magnetron 368 of the RF generator 370 to the tank 352. The piping 372 extends for a predetermined distance below the top surface 366 to penetrate any resulting solid oil layer by recirculating the deionized anode cooling solution through the piping 372 submerged in the oil.

In applying the method and apparatus of the present invention to coal, the order of production of the various fractions present in the raw deposit has been found to be close to ideal. First water vapor and water is heated and expands to fracture the substrate or bedding plan forming numerous flow paths through which the water and the other fractions will flow into the well bore. The resulting water which is condensed after distillation is a high quality distillate with very low contamination. In this regard, it should be noted that some of the lower order lignites and subbituminous coals have a very high percentage of water content, e.g., 30% or more. Sulfur gas is produced next at approximately 230° F. It can be stored in a closed system until it is condensed and run through a kiln to reduce it to elemental sulfur after which it can be stored in a stockpile. It has been observed that when free sulfur gas is added to calcined petroleum coke, it contacts the organic sulfur released by pyrolysis and for some unknown reason, speeds the reaction. Advantageously, the electromagnetic energy heating process of the present invention removes sulfur at very low temperatures to provide exceedingly rapid and efficient sulfur removal, exhibiting characteristics similar to those of the aforementioned reaction.

Next, the various gases and oil are produced. The gases will vary according to the particular coals from which they are produced. The condensable end products such as propanes, gasolines and coal tars are separated and scrubbed. The noncondensibles such as methane, carbon dioxide, carbon monoxide and hydrogen sulfide can be used as fuel for electric generating equipment or stored for future use. Moreover, this fuel is cleansed of contaminates so that the need for stack gas scrubbers or electrostatic precipitators is eliminated.

The method and apparatus of the present invention can be advantageously utilized for de-emulsifying hydrocarbon fluid which consists of oil, basic sediment and water to separate the oil therefrom. However, it has been found critical when heating the contained hydrocarbon liquid with RF energy, to control the heating so that the water does not reach its boiling point. If the water is heated above its boiling point, the resulting steam will begin to penetrate the oil thereby further creating or assisting in maintaining the oil, basic sediment and water emulsion. (However, it should be understood that in removing fractions from coal, the water in the coal can be heated beyond its boiling point, as desired, to facilitate the removal of water as steam.) After such heating and a dwell time which may be followed by additional heating as desired to optimize separation and oil production, the liquid will separate into a top layer of clean oil, a second layer of mostly oil with some water and basic sediment, and a bottom layer of clear water with basic sediment at the bottom of the vessel. To speed up the removal of basic sediment from the oil and further remove fines, salt water or brine may be introduced into the top of the vessel and spread over the separated and heated top layer of oil. The brine rapidly gravitates downwardly through the oil due to its heavier weight so that it accumulates and carries with it sediment present in the oil.

The disposal of drilling mud has become a severe problem for the oil industry. The method and apparatus of the present invention can also be advantageously utilized for reconstituting oil well drilling fluids such as drilling mud for reuse. This is accomplished by applying RF waves to heat the liquids (primarily water) in the drilling mud to their boiling point to boil out the excess liquids, e.g., approximately 50% of the water, leaving behind a usable composition of bentonite, bairite salts, etc., which may then be reclaimed. As desired, oil can also be separated from the drilling mud and well bore cuttings. The removed water which is in its vapor or steam phase may be compressed into high pressure steam suitable for running a turbine.

Further, it is known that as oil is heated its volume expands. Therefore, if ambient temperature oil is heated to 400° F., the increase in volume would be nearly 40% greater than the original volume. A 100° F. temperature increase from ambient causes approximates a 5% expansion in the volume of the oil. The RF energy heating process of the present invention can be effectively utilized to increase the yield of the oil due to the low energy costs associated with generating RF waves to accomplish this heating and the resulting expansion.

It is also known that water volume increases with increasing temperature and that water has a much greater dielectric constant and loss tangent than oil, and therefore greater lossiness or ability to absorb electromagnetic energy than oil. Therefore, RF energy will penetrate the oil film encapsulating any water molecules and first heat the water molecules resulting in expansion of the same and rupture of the oil film. The freed water molecules will combine with other water molecules and sink to the bottom of the container, carrying basic sediment with them. Moreover, the expansion of both oil and water during the heating process will aid in removal of the oil from a geological substrate. However, a supplementary drive mechanism, such as steam injection which is shown in FIG. 10, may be used to further facilitate removal, particularly after the expansionary volume increase in the oil and water immediately adjacent the end of the borehole has been exhausted.

It has further been found that the application of RF energy in accordance with the method and apparatus of the present invention to paraffinic oils causes the paraffin to homogenize with the other hydrocarbons present in the oil so that it remains in solution after application of the RF energy is terminated. Such paraffin deposits often ultimately result in clogging or a stoppage of flow. Thus, apparatus in accordance with the present invention can be effectively used to clean pipelines, vessels and other surfaces upon which paraffin is deposited.

This method is in stark contrast to heating by conduction which causes the paraffin in paraffinic oils to cloud out of the fluid and build up in pipelines, vessels and on other surfaces.

Advantageously, hydrocarbon fluids treated with RF energy in accordance with the present invention exhibit lower pour points than hydrocarbon fluids treated with other conventional heating techniques. This effect is particularly striking in oil produced from the kerogen present in oil shale. Moreover, coal treated with RF energy in accordance with the present invention enjoys a substantial increase in the yield of hydrocarbon as compared with conventional techniques.

In operating the apparatus illustrated in FIG. 1, the RF waves generated by the RF generator 16 are transmitted to the radiotransparent applicator 18 through the waveguide portions 44, 36 and 21. These waves are deflected outwardly into the hydrocarbon fluid by the energy deflector 64. The temperature rise in the various layers of the hydrocarbon fluid is then sensed by the temperature sensors 60A–D which transmit signals representing temperature information to the controller 58. The controller 58 then controls the actuation of the motor 66 to move the energy deflector 64 upward or downward to insure that the boiling point of the fluid is not exceeded in any portion thereof and to maximize production and de-emulsification of the hydrocarbon fluid into layers of clean oil, mostly oil with some basic sediment, and water and basic sediment, while maintaining continuous full power of the magnetron 17 to provide the greatest efficiency and prolong the life of the filament or anode. Moreover, a gun barrel heater 75 may be utilized to further heat the oil once the water has been separated from the oil by electromagnetic energy heating and the oil is sufficiently liquified to enable convection currents to flow and aid in further reducing the viscosity and dropping out fine sediment present in the oil. The oil may then be removed through valves 74C and 74D. Additionally, gases and acids may be removed, as desired. Any remaining residue of drilling mud or basic sediment can be removed via access hatch 73.

The energy deflector 64 illustrated in FIG. 1 is enlarged in FIG. 2. However, it should be understood that the energy deflector can be constructed as shown in FIG. 3 to concentrate the RF waves in a below horizontal payzone or coal seam, as shown in FIG. 4 to increase the volume over which the waves are broadcast by diffusing the concentration of the RF energy; as shown in FIG. 5 to provide a segmented or unidirectional broadcast which concentrates the RF energy over a specific broadcast zone, e.g., over 30°, and as shown in FIG. 6 to provide an adjustable angle of deflection to the energy deflector so that the RF waves can be deflected upwardly, downwardly or at an angle of 90°, as desired.

In operating the apparatus 100 illustrated in FIG. 7, the output of the magnetron 106 is transmitted to the coaxial waveguide 108 and tubular waveguide 116 and from there through the radiotransparent applicator 118 to the energy deflector 120 where the electromagnetic energy is deflected into the hydrocarbon fluid. After the fluency of the hydrocarbon fluid has increased sufficiently for ease of flow, the heated oil may be discharged by, e.g., a suction pump 122. The deflected RF waves are absorbed by the oil and water mixture or penetrate slightly into the inner skin of the internal walls, heating the oil trapped in the pores, and then reflecting to another internal surface until all of the energy is converted into heat in the fluid. If desired, the energy deflector 120 may be preprogrammed to continuously or intermittently cycle to broadcast RF waves over predetermined portion of the fluid volume. Further, as previously discussed, the RF energy will also remove rust and scale from the interior walls of the vessel 102 to provide clean metal surfaces in the oil storage compartments. The rust and scale settles to the bottom of the vessel as basic sediment.

In operating the apparatus of FIG. 8 with oil pipelines 144, RF energy (dotted arrows) is transmitted through the waveguide 132 and the radiotransparent disc 138 into the T connection 130 and the pipeline 144. The RF energy heats the oil reducing its viscosity while at the same time melting the paraffin on the sidewalls of the pipeline 144 and in the T connection 130 to cause the same to homogenize with the other hydrocarbons in the oil and remain in solution.

In operating the apparatus of FIG. 9, RF waves generated by the magnetron 160 are transmitted to the applicator 188, which includes an energy deflector (not shown), through waveguide 164, extension 166, adapter 170, flexible coaxial waveguide 174, adapter 178, transition member 182, and waveguide 186. The position of the energy deflector is adjusted in the applicator 188 in accordance with the output from a controller (not shown) which receives input signals from thermocouples 194, as described with reference to FIG. 1. As described with reference to FIG. 1, control signals are sent to a motor to drive a pulley which winds or unwinds a cable to raise or lower the RF deflector attached thereto in accordance with the temperature sensed by the thermocouples 194. Additionally, the angle or incline of the conically shaped energy deflector may be adjusted to concentrate the RF waves in a particular payzone or to intercept the dip in a coal seam. This adjustment can be accomplished by a remote or proximate motor which moves the segments 95A–D of the deflector 93 illustrated in FIG. 6 inwardly and outwardly to change the angle of deflection in response to output signals from the controller.

The RF waves are deflected radially outward from the applicator into the payzone to heat the hydrocarbon material causing the release of steam and gas, and increasing the fluency of the hydrocarbon fluid so that the fluid flows into the bottom of adjacent producing wells 154 (only one of which is shown in FIG. 9). It should be understood that there will normally be a plurality of producing wells adjacent to the injection well 152 to receive the released hydrocarbon fluid. The pump set 200 of the producing well 154 will then pump the oil, water and gas mixture through a production string 206 by movement of a sucker rod 210. Advantageously, a supplementary gas drive system may be used to inject gas into the annulus 199 between the injection well casing 190 and the waveguide 186 to aid in driving the hydrocarbon fluid to the production well 154.

In operating the injection well 220 illustrated in FIG. 10 to recover fractions from oil shale, coal, peat, lignite or tar sands, the generated RF waves are transmitted to the radiotransparent applicator 234 through a flexible coaxial waveguide 244, transition member 242 and waveguide 232. The RF waves propagated through the applicator 234 are deflected by the energy deflector 236 into the desired payzone 226 below the overburden 224. The resulting water, gas and oil fractions resulting from the solidified oil in the vicinity of the applicator 234 flow into the open hole sump 256, and expand upwardly in the annulus 254. Further, under the influence of drive means such as low pressure extraction steam which is supplied through annulus 254, additional fractions are forced upwardly through the annulus 254. The steam is received in a water line 260 which carries the vapor and condensate to a demineralizer 262 and then to a condensate tank 264 prior to application to the boiler 252. The boiler 252 produces high pressure steam to drive turbine 250 which drives electrical generator 248 enabling it to supply power to the RF generator 246. The low pressure steam existing from the turbine is applied to the annulus 254 through steam line 251.

Oil and gases, including hydrogen and sulfur, are removed from the annulus 254 by line 258 which supplies the same to a separator 261 where the oil and gases are separated. The oil is then transmitted to storage tanks prior to pipeline transmission. The gases exiting from the separator 261 are applied to a conventional gas separating system to provide oil, naphthalenes, phenols, hydrogen, sulfides, and fuel oil.

The angled energy deflector 280 shown in FIG. 11 may be advantageously used in radiotransparent applicators for geological substrates in which the payzone 284 is inclined relative to the injection well bore 282 to concentrate the RF energy in the payzone 284.

The coaxial waveguide 300 of FIG. 12 provides a central conductor 316 or conduit through which oil can be pumped to the surface, thereby eliminating the need for a supplementary drive system. This arrangement can be used with above ground vessels as well as for in situ applications, as desired.

Further, referring to FIG. 13, in storage vessels where it is desired to provide an insulating layer for the hydrocarbon carbon fluid contained therein, a portion of the hydrocarbon fluid may be utilized to serve this function by utilizing a perforated metal shield 354 which is affixed to the interior sidewall 356 of the tank 352. The shield 354 effectively shields the layer of hydrocarbon fluid positioned between the sidewall 356 and the shield 354 from exposure to the RF waves. If insulation is desired along the top surface 366 and bottom surface 359, shields 357 and 355, respectively, can also be employed.

Under warm temperature conditions, the hydrocarbon fluid within the vessel 352 has a sufficiently low viscosity to enable the oil to freely flow through the perforations 360. However, in cold weather or under cold temperature conditions, the viscosity of the oil will increase to the point where it can no longer readily flow through the perforations 360. Additionally, the shield 354 prevents the RF waves from heating the layer of hydrocarbon fluid trapped between the interior sidewall 356 and the metal shield 354. Thus, an insulating layer is formed by the hydrocarbon fluid exterior to the shield 354 while the hydrocarbon fluid interior of the shield 354 is heated by the RF waves to maintain its fluency. The solid layer serves to insulate the interior heated oil, preventing heat loss to the surrounding environment. If employed, the shields 357 and 355 function to insulate the top and bottom surfaces 366 and 359, respectively, in the same manner as shield 354 functions to insulate the sidewalls of the vessel 352. The heated anode fluid is circulated into the vessel 352 through piping 372 which extends a sufficient distance below the surface of the oil to provide a vapor passage through the solidified top layer of oil to prevent implosion.

As previously discussed, the electromagnetic energy to be employed will have a frequency or frequencies in the range of 300 megahertz to 300 gigahertz depending upon the lossiness of the fractions to be removed from the hydrocarbon material. Such frequencies are selected for the most efficient absorption of energy by the fractions to accomplish separation of two or more dissimilar materials in the most efficient manner. However when employing multiple frequencies it may be desired to also use electromagnetic energy having a frequency below 300 megahertz, e.g. such as 100 hertz for Bayol, with varying field strengths, in accordance with the lossiness of the material.

It should be understood by those skilled in the art that various modifications may be made in the present invention without departing from the spirit and scope thereof, as described in the specification and defined in the appended claims.

What is claimed is:

1. A method for sequentially recovering fractions from hydrocarbon material, comprising the steps of:

generating electromagnetic energy in the frequency range of from about 300 megahertz to about 300 gigahertz;

broadcasting the generated electromagnetic energy to a deflector, the deflector deflecting the electromagnetic energy towards a plurality of locations in the hydrocarbon material for exposure thereto;

exposing the hydrocarbon material at the plurality of locations to the electromagnetic energy;

sensing the temperature of the hydrocarbon material by means of sensors that are positioned at the plurality of locations;

moving the deflector and deflecting the electromagnetic energy towards the hydrocarbon material as a function of the temperature sensed at the plurality of locations to control the temperature of the hydrocarbon material at said plurality of locations;

continuously generating the electromagnetic energy while selectively changing the locations of the deflector relative to the hydrocarbon material in response to the temperature sensed by the sensors to concentrate the electromagnetic energy in different locations of the hydrocarbon material as a function of the temperature sensed at the plurality of locations;

sequentially separating the hydrocarbon and other material into fractions; and removing the fractions resulting from exposure of the hydrocarbon material to the electromagnetic energy.

2. The method recited in claim 1, wherein:

the hydrocarbon material is selected from the group consisting of oil shale and oil.

3. The method recited in claim 1, including the step of:

providing a plurality of frequencies in accordance with the fractions desired to be removed to provide the most efficient energy absorption frequencies for separation of the fractions from the hydrocarbon material.

4. The method recited in claim 3, including the step of additionally generating electromagnetic energy having a frequency that is below 300 megahertz.

5. The method recited in claim 1, including the step of:

varying the frequency of the electromagnetic energy in accordance with the fraction desired be removed to provide the most efficient energy absorption for separation of the fraction from the hydrocarbon material.

6. The method recited in claim 1 in which the hydrocarbon material is hydrocarbon liquid, including the step of:

preventing the water present in the hydrocarbon liquid from reaching its boiling point during exposure to the electromagnetic energy.

7. The method recited in claim 1, wherein the hydrocarbon material is drilling mud, including the step of:

continuing the exposure of the drilling mud to the electromagnetic energy for a sufficient period of time to remove excess liquids from the drilling mud leaving a slurry or residue.

8. The method recited in claim 1, including the steps of:

periodically sweeping the hydrocarbon material with electromagnetic energy;

commencing the sweeping with electromagnetic energy near the bottom of the hydrocarbon material and moving upwardly.

9. The method recited in claim 1, including the step of:

providing an inert gas shield to prevent any gases emanating from the hydrocarbon material from interfering with the generation of the electromagnetic energy.

10. The method recited in claim 1, including the step of:

purifying the hydrocarbon material by disintegrating any bacteria and algae present therein by exposure of the hydrocarbon material to the electromagnetic energy.

11. The method recited in claim 1, in which the hydrocarbon material is coal, including the step of:

heating any water present in the coal to its boiling point to facilitate removal of the water as vapor.

12. The method recited in claim 1, in which the hydrocarbon material is a coal slurry, including the step of:

dewatering the coal slurry by exposing the same to electromagnetic energy to heat the water present in the coal slurry to its boiling point, thereby facilitating the removal of excess water.

13. A method of recovering oil from a contained high viscosity hydrocarbon fluid including oil, water and basic sediment, comprising the steps of:

generating electromagnetic energy in the frequency range of from about 300 megahertz to about 300 gigahertz;

broadcasting the generated electromagnetic energy to a deflector, the deflector deflecting the electromagnetic energy towards a plurality of locations within the hydrocarbon fluid;

sensing the temperature of the hydrocarbon fluid at a plurality of selected locations by means of a plurality of temperature sensors;

moving the deflector and deflecting the electromagnetic energy and varying the locations in the hydrocarbon fluid to which the electromagnetic energy is deflected as a function of the temperature sensed at the plurality of locations to control the temperature of the various layers within the hydrocarbon fluid to prevent any water present from reaching its boiling point;

continuously generating the electromagnetic energy while selectively changing the locations of the deflector relative to the hydrocarbon fluid in response to the temperature sensed by the sensors to concentrate the electromagnetic energy in different locations of the hydrocarbon material as a function of the sensed temperature at the plurality of locations; and removing the separated oil from the hydrocarbon fluid after sufficient time has elapsed after exposure of the hydrocarbon fluid to the electromagnetic energy to allow the water, any sulfur present and basic sediment to separate from the oil.

14. The method recited in claim 13, including the step of:

spreading brine over the top surface of the heated and separated oil so that the heavier brine will gravitate downwardly through-the oil and carry with it any sediment remaining in the oil to effectively wash the oil of sediment.

15. The method recited in claim 13, including the step of:

filtering the resulting oil to remove any fine sediment remaining therein.

16. The method recited in claim 13, including the steps of:

sensing the temperature at a plurality of locations in the hydrocarbon fluid;

deflecting the electromagnetic energy to certain portions of the hydrocarbon fluid in accordance with the temperature sensed at the various locations in the hydrocarbon fluid.

17. The method recited in claim 13, including the step of:

varying the frequency and field strength of the electromagnetic energy in accordance with the composition of the hydrocarbon fluid to provide the most rapid and energy efficient absorption frequency for separating the oil from the water and basic sediment.

18. The method recited in claim 13, including the step of:

providing a plurality of frequencies in accordance with the fractions desired to be removed to provide the most efficient energy absorption frequencies for separation of the fractions from the hydrocarbon fluid.

19. The method recited in claim 18 including the step of additional generating electromagnetic energy having a frequency that is below 300 megahertz.

20. The method recited in claim 13, including the steps of:

arranging temperature sensors at predetermined locations within the hydrocarbon fluid to sense the temperature of various layers of the hydrocarbon fluid;

positioning a radiotransparent applicator for propagation of electromagnetic energy within the contained hydrocarbon fluid;

providing a movable deflector within the radiotransparent applicator for deflection of electromagnetic energy propagated through the radiotransparent applicator into the hydrocarbon fluid;

varying the position of the deflector within the radiotransparent applicator in accordance with the temperatures sensed by the temperature sensors to concentrate the electromagnetic energy over a particular volume of the hydrocarbon fluid to maintain desired temperatures throughout the hydrocarbon fluid;

arranging removal means at various levels of the contained hydrocarbon fluid for removing the resulting fractions present at that level.

21. The method recited in claim 20, including the step of:

coupling the radiotransparent applicator to a radio frequency generator through a waveguide.

22. The method recited in claim 20, including the steps of:

initially positioning the deflector near the bottom of the hydrocarbon fluid to first heat the bottom layer;

gradually moving the deflector upwardly to heat the remainder of the hydrocarbon fluid.

* * * * *